US006066224A

United States Patent [19]

Santucci et al.

[11] Patent Number: 6,066,224

[45] Date of Patent: May 23, 2000

[54] TRIDIMENSIONAL PRINTING PROCESS ON FABRIC

[75] Inventors: Piero Santucci, Bastia Umbra; Giuseppe Trabalza, Perugia Frazione Ponte San Giovanni; Teseo Venturini, Assisi Frazione Fordandrea, all of Italy

[73] Assignee: Seri 7 Di Venturini Teseo E C.-S.N.C, Italy

[21] Appl. No.: 09/165,411

[22] Filed: Oct. 2, 1998

[30] Foreign Application Priority Data

Oct. 7, 1997 [IT] Italy ..... AN97A0053

[51] Int. Cl.[7] ..... B32B 31/20

[52] U.S. Cl. ..... 156/220; 156/277; 156/245; 264/132; 264/258; 442/263

[58] Field of Search ..... 264/258, 132, 264/134, 247, DIG. 60; 428/187, 79, 200, 190, 542.6, 913.3; 156/219, 240, 245, 209, 220, 277; 442/263, 260; 2/246, 122, 255

[56] References Cited

U.S. PATENT DOCUMENTS

| | | | |
|---|---|---|---|
| 1,852,964 | 4/1932 | George | 428/174 |
| 2,062,336 | 12/1936 | Sexton | 442/263 |
| 4,585,684 | 4/1986 | Mackarous | 428/79 |
| 5,783,137 | 7/1998 | Porta | 264/510 |
| 5,914,176 | 7/1998 | Myers | 428/195 |

*Primary Examiner*—Jeff H. Aftergut
*Assistant Examiner*—Gladys Piazza
*Attorney, Agent, or Firm*—Leonard Bloom

[57] ABSTRACT

This invention relates to a tridimensional printing process on fabric in which a fabric insert capable of being thermo-molded is glued on the back of a design silk-screened on a piece of fabric. One side of the said insert is coated with a latex emulsion that, when subject to hot-pressing inside a mould, irreversibly gives a convex shape to the whole insert, as well as a relief finish to the above mentioned design silk-screened on the fabric.

2 Claims, 1 Drawing Sheet

TRIDIMENSIONAL PRINTING PROCESS ON FABRIC

BACKGROUND OF THE INVENTION

This patent application relates to a tridimensional printing process on silk-screened fabric in order to obtain ornamental designs or relief writings. It is understood that the exclusive right resulting from the present patent also extends to the fabric decorated with tridimensional designs or writings obtained with the above mentioned process.

As it is known, the application of designs or writings on T-shirts, hats or other garments is particularly popular today. Such decorations are mostly made with silk-screen printing and, less frequently, they are obtained by hot-pressing plastic inserts used as a support for the said decorations. In view of the considerable success encountered by garments decorated with writings, designs or images, the object of the invention is to further develop this technology to decorate the said garments with designs or writings having a relief finish on the fabric.

SUMMARY OF THE INVENTION

In order to obtain this result, the process according to the present invention has been developed, which, as far as we know, has no similar or equivalent technological antecedents.

This new process comprises various specific operating phases. In the first phase, the design or writing is printed on the fabric by means of standard silk-screen printing.

To provide the relief finish, a fabric insert is applied on the inner side of the fabric (that is on the back of the above mentioned silk-screened design). The insert features exactly the same perimeter as the design or the writing to be made on the outer side of the fabric.

The stable application of the said insert is made possible by the fact that the side of the insert facing the fabric features a layer of sticky compounds. The other side of the insert is coated with a latex emulsion capable of being thermomolded with relief finish by means of a specific thermal treatment inside a mold.

In this way the whole insert is given a tridimensional convex structure, of semi-rigid and irreversible nature, which is also being indeformable, unshrinkable, washable and atoxic.

In particular, the hot-molding process is carried out on the inner side of the insert (that is the side coated with the above mentioned latex emulsion) from the back to the front, to obtain a concave area on the inner side of the fabric and a relief area on the outer side of the same fabric in correspondence with the insert itself.

In view of the perfect alignment of the design silk-screened on the fabric with respect to the insert, it is easily understood that the relief molding of the insert causes the "raised" finish of the design silk-screened on the front of the fabric.

For a clearer explication, the description of the invention continues with reference to the enclosed drawing, that only has an explanatory, not restrictive purpose, in which:

BREIF DESCRIPTION OF THE DRAWINGS

DESCRIPTION OF THE PREFERRED EMBODIMENTS

Figure 3:
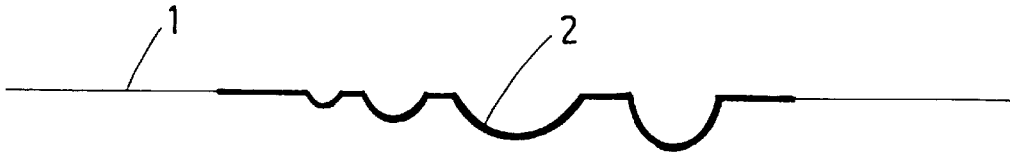
FIG. 3 is a cutaway view of the silk-screened fabric with relief finish, just drawn from the mold.
Figure 2:
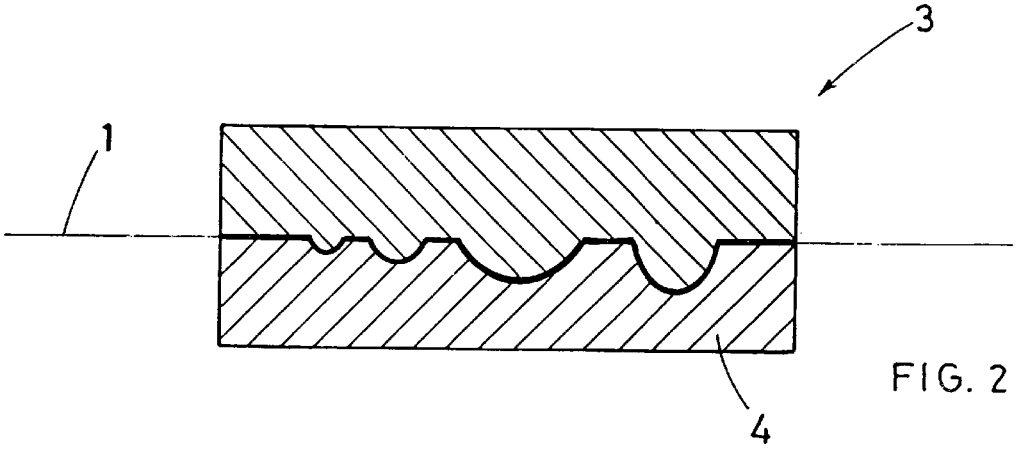
FIG. 2 is a cutaway view of the mold in which both the silk-screened and the insert are introduced.
Figure 1:
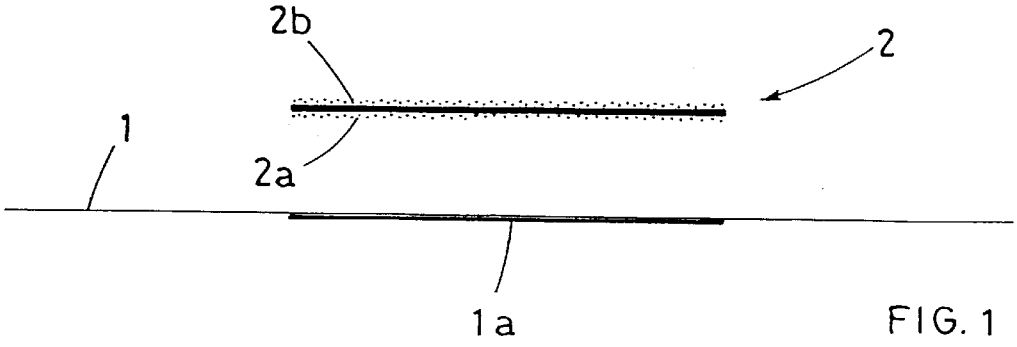
FIG. 1 is a cutaway view of the silk-screened fabric and the insert, being still separated.

With reference to the enclosed figures, the process according to the invention comprises the following sequence of operations:

- creation by means of silk-screen printing of a design (1*a*) on the outer side of a piece of fabric (1);
- preparation of an insert (2) made of fabric and coated with a layer of sticky compounds on one side (2*a*) and with a layer of latex emulsion on the opposite side (2*b*);
- profiling—preferably by means of appropriate hollow punches—of the said insert (2) in order to obtain exactly the same perimeter as the design (1) on the front of the fabric (1);
- insertion of the silk-screened portion (1*a*) of the above mentioned fabric (1) in a mold (3) whose impression has exactly the same perimeter as the design (1*a*), being the said design (1*a*) positioned on the bottom of the impression of the mold (3);
- insertion inside the mold (3) of the above mentioned insert (2), treated with glue and latex, so that the glued side (2*a*) of the insert is positioned on the inner side of the fabric (1) and its perimeter perfectly matches the perimeter of the design (1*a*) on the outer side of the fabric (1);
- closing of the mold (3) by means of the cover (4);
- hot-pressing process in order to obtain the adhesion of the glued side (2*a*) of the insert (2) to the inner surface of the fabric (1) and the thermomolding of the emulsified side (2*b*) of the insert (2) that "reproduces" the convex shape of the impression of the mold (3).

It must be added that some additional devices have been foreseen in order to optimize the industrial application of the said process.

The exact coincidence inside the mold between the glued, emulsified insert (2) and the silk-screened design (1*a*) of the fabric (1) is obtained by means of a special semi-automatic tracking system that guarantees a perfect alignment.

The spaces existing between the edges of the mold (3) and the cover (4), as well as the dimensions of the mold, vary according to the type of fabric used and the design to be obtained.

As regards the hot-pressing process, it must be specified that the molds are heated at the necessary temperature in order for the fabric (1) and the glued insert (2) to join in an irreversible way and form a single piece. The molds are mechanically operated by a press provided with timers and capable of impressing the desired shape on the insert.

Finally, it is necessary to specify the composition of the compounds (sticky layer and latex emulsion) used to coat the opposed sides of the insert (2) to be applied on the inner side of the silk-screened fabric.

The adhesive side (2*a*) of the insert (2) is treated in sequence with two different coating layers, that are preferably applied during the silk-screen printing. The first coating layer is obtained with a thermoplastic ink (known on the market as "Plastisol") of the same color as the fabric.

This layer of colored Plastisol has two functions: to make the fabric of the insert (2) waterproof and to "camouflage" the insert (2) with respect to the inner side of the fabric (1), thus preventing an unpleasant chromatic contrast between the insert (2) and the fabric (1).

The second coating layer is applied on the above mentioned layer of colored Plastisol and represents the adhesive layer, consisting in a sticky emulsion made of:

transparent thermoplastic ink (Plastisol);

thermoadhesive granules with 160–180° C. melting point;

pure white spirit.

The proportion of ingredients is as follows: 300 g of thermoadhesive granules and 100 g of pure white spirit must be added to 1,000 g of transparent Plastisol.

The side (2*b*) of the insert (2) which is subject to thermomolding is coated with an emulsion made up of:

50% SS87 Europrene latex (marketed by Bigagli from Prato, Italy) in a percentage ranging from 30 to 80%;

water transparent base for silk-screen printing, in a percentage ranging from 70 to 20%;

AD thickening agent (marketed by Bigagli from Prato, Italy) in a percentage ranging from 5 to 10% of the total of the two above mentioned components.

The invention claimed is:

1. Tridimensional printing process on a fabric garment, comprising the following sequence of operations:

creation by means of silk-screen printing of a design (1*a*) on the outer side of a piece of fabric garment (1);

preparation of an insert (2) made of fabric and coated with a layer of sticky compounds on one side (2*a*) and with a layer of latex emulsion on the opposite side (2*b*);

profiling of the said insert (2) in order to obtain exactly the same perimeter as the design (1) on the front of the fabric garment (1);

insertion of the silk-screened portion (1*a*) of the above mentioned fabric garment (1) inside a mold (3) whose impression has exactly the same perimeter as the design (1*a*), being the said design (1*a*) positioned on the bottom of the impression of the mold (3);

insertion inside the mold (3) of the above mentioned insert (2), treated with glue and latex, so that the glued side (2*a*) of the insert is positioned on the inner side of the fabric garment (1) and its perimeter perfectly matches the perimeter of the design (1*a*) on the outer side of the fabric garment (1);

closing of the mold (3) by means of the cover (4);

hot-pressing process in order to obtain the adhesion of the glued side (2*a*) of the insert (2) to the inner surface of the fabric garment (1) and the thermomolding of the emulsified side (2*b*) of the insert (2) that "reproduces" the convex shape of the impression of the mold (3).

2. Tridimensional printing process on the fabric garment, according to claim 1, characterized by the fact that the adhesive side (2*a*) of the insert (2) is covered with a first layer of thermoplastic ink (known on the market as "Plastisol"), preferably of the same color as the fabric garment (1) and with a second layer of sticky emulsion obtained by mixing transparent thermoplastic ink (Plastisol), thermoadhesive granules with 160–180° C. melting point and pure white spirit in the proportion of 300 g of thermoadhesive granules and 100 g of pure white spirit for each 1000 g of transparent Plastisol, the side (2*b*) of the insert (2) which is subject to thermomolding being coated with an emulsion made up of: 50% SS87 Duroprene latex in a percentage ranging from 30 to 80%; water transparent base for silk-screen printing, in a percentage ranging from 70 to 20% and AD thickening agent in a percentage ranging from 5 to 10% of the total of the latex and the base.

* * * * *